US005623270A

United States Patent [19]

Kempkes et al.

[11] Patent Number: 5,623,270

[45] Date of Patent: Apr. 22, 1997

[54] PHASED ARRAY ANTENNA

[75] Inventors: Michael A. Kempkes, Westford; Melvyn I. Wiener, Lexington, both of Mass.

[73] Assignee: Riverside Research Institute, New York, N.Y.

[21] Appl. No.: 321,784

[22] Filed: Oct. 12, 1994

[51] Int. Cl.[6] ..... H01Q 3/22; H01Q 3/24; H01Q 3/26

[52] U.S. Cl. ..... 342/372; 342/174; 342/442

[58] Field of Search ..... 342/372, 174, 342/173, 157, 442

[56] References Cited

U.S. PATENT DOCUMENTS 4,931,803 6/1990 Shimko .
4,959,531 9/1990 Marino .
5,109,349 4/1992 Ulich .
5,165,414 11/1992 Larson, III .
5,168,673 12/1992 Nemir .
5,202,776 4/1993 Gesell et al. .

*Primary Examiner*—Theodore M. Blum
*Attorney, Agent, or Firm*—Brumbaugh, Graves, Donohue & Raymond

[57] ABSTRACT

A phased array antenna system compensates for the effects of antenna flexure, vibration and movement, and thereby negates these effects by introducing an appropriate phase or time delay into the signals being radiated from and received by the discrete antenna elements comprising the phased array antenna. This compensation eliminates the need for massive rigid back structures to maintain antenna rigidity, which thereby simplifies antenna design.

30 Claims, 6 Drawing Sheets

PHASED ARRAY ANTENNA

SPECIFICATION

BACKGROUND OF THE INVENTION

The present invention relates to electronically steered phased array antennas and, more particularly, to systems for correcting errors associated with undesirable movement, vibration and flexure thereof.

In electronically steered phased array antennas, the forming and shaping of the radiated and/or received beam is performed by an array of discrete antenna elements in conjunction with phase shifters which insert a specified amount of phase shift into the signal being radiated from and received by each antenna element. The amount of phase shift to be introduced for each discrete antenna element is a function of the desired beam pointing angle and the desired beam shape. Individual phase shift amounts for each phase shifter are calculated by a microcomputer and are communicated to the individual phase shifters.

A state-of-the-art solid state radar transmitter/receiver module (T/R module) combines, on a single integrated circuit board, a phase shifter, a transmit/receive switch (T/R switch), a transmit amplifier, a receive amplifier, and a T/R module controller. An integral antenna element may also reside on or be co-located with the integrated circuit T/R module.

An electronically steered phased array antenna may be constructed with an array of T/R modules and associated antenna elements in which the respective T/R modules are each connected to a data bus which feeds phase delay information to the individual T/R modules.

However, performance of such phased array antennas can be sharply reduced due to unwanted movement, flexure and vibration of the phased array antenna on its platform. This movement, flexure and vibration causes displacement of the antenna elements with respect to one another which in turn causes errors to be introduced into the operation of the antenna array. These errors are particularly pronounced when an antenna array operates at a relatively high microwave frequency such as X-band or higher. Unwanted movement, flexure and vibration causes errors to some degree in all antenna arrays but such errors are most pronounced in antenna arrays having relatively lightweight and flexible back structures, such as where a lightweight antenna array is mounted on an aircraft or other vehicle.

To combat such unwanted movement, flexure and vibration, rigid back structures are presently used to precisely and rigidly support the array of discrete antenna elements and to thereby fix the relative position of each antenna element in order to eliminate flexure across the overall antenna. By rigidly fixing the relative position of each discrete antenna element, the relative position of each antenna element with respect to other elements and with respect to the antenna platform remains constant and need not be compensated for in controlling the phase shift of signals provided to the discrete antenna elements.

However, in modern high resolution radar systems, the antenna flexure tolerances required to maintain acceptable resolution are extremely low. As a result, the back structures required to maintain such low tolerances are quite massive and present numerous design obstacles. For example, these back structures are considerably large and heavy and, in an airborne environment, often require extensive and costly modifications to the host aircraft in order to accommodate them.

It is therefore an object of the present invention to provide an array antenna system that eliminates the need for these massive rigid back structures and still obtain high resolution in an imaging radar system.

SUMMARY OF THE INVENTION

In accordance with the present invention, there is provided an antenna system having at least one antenna element, a signal generator for providing signals to that antenna element for radiation and/or, a receiver for detecting signals received by that antenna element, and a phase controller for controlling the phase of the radiated and the received signals. The antenna system also includes a position detector located near the antenna element for determining the physical position of the antenna element with respect to a nominal position, a computer for computing a phase delay corresponding to the antenna elements' physical position with respect to that nominal position, and circuitry to operate the phase controller to compensate for the computed phase delay.

In accordance with the invention there is further provided such an antenna system in which at least portions of the signal generator, receiver, phase controller and position detector are arranged together and adjacent to the antenna element.

In accordance with the invention there is further provided such an antenna system in which the position detector is derived from an accelerometer.

In accordance with the invention there is further provided such an antenna system in which compensating for the antenna elements' physical position with respect to the nominal position negates the effects of flexure, vibration and movement on the antenna elements within the antenna system.

In accordance with the invention there is further provided an antenna array having multiple antenna elements for radiating and receiving electromagnetic signals, a signal generator for providing signals to the antenna elements for radiation therefrom, a receiver for detecting signals received by the antenna elements, and a phase controller for controlling the phase of the radiated and received signals. The antenna array also includes at least one position detector located at each antenna element for determining the physical position of the antenna element with respect to a reference antenna element in the antenna array, a computer for computing the deviation of the antenna elements' physical position from a nominal position with respect to the reference antenna element and for computing a phase delay for each position detector, and circuitry to operate the phase controller to compensate for the computed phase delay.

For a better understanding of the present invention, together with other and further objects, reference is made to the following description, taken in conjunction with the accompanying drawings, and its scope will be pointed out in the appended claims.

DESCRIPTION OF THE PREFERRED EMBODIMENT

Figure 1:
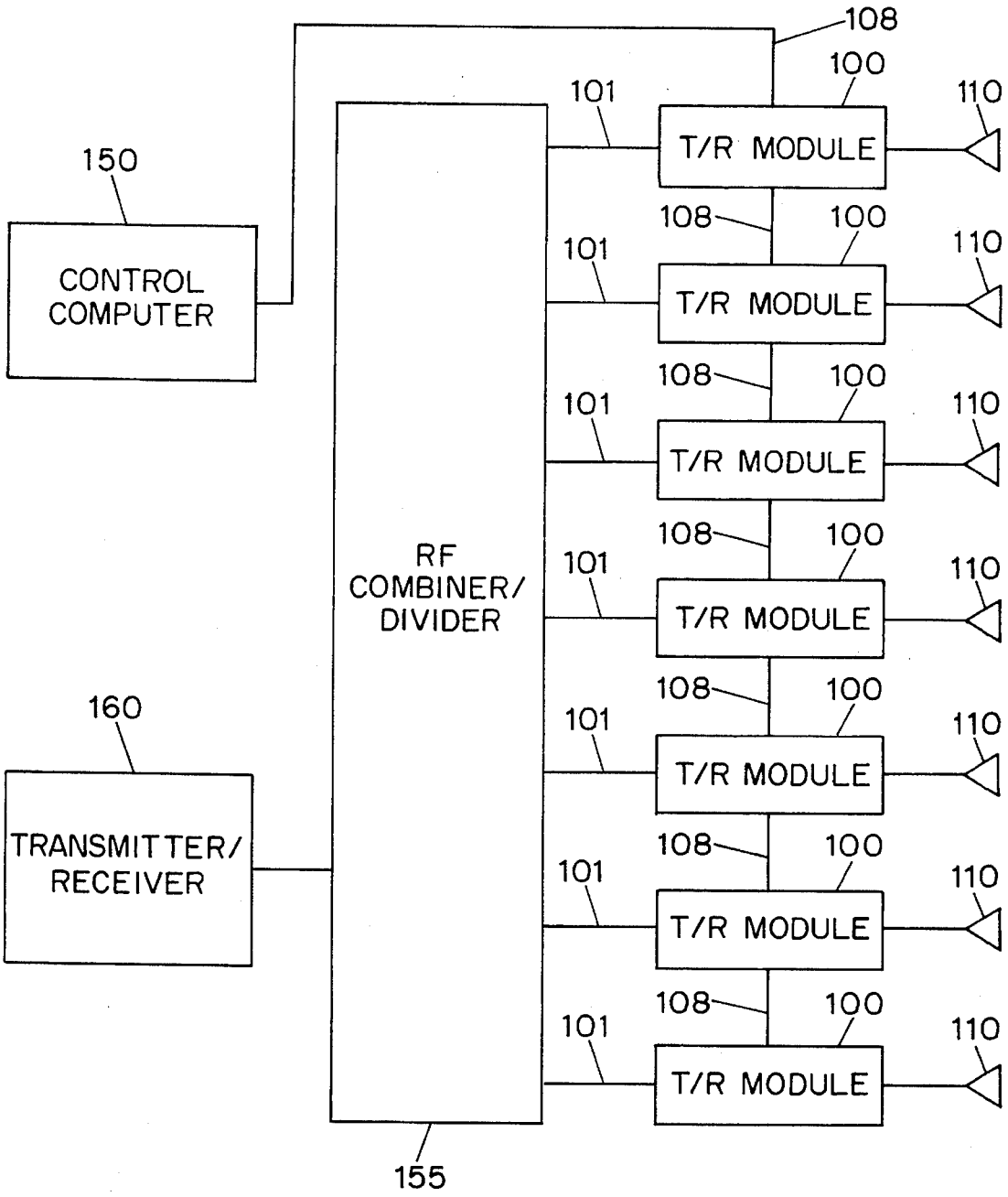
FIG. 1 is a block diagram of an array antenna system in accordance with the present invention.

FIG. 1 depicts a block diagram of an electronically steered phased array antenna in accordance with the present invention. The antenna array depicted in FIG. 1 comprises a transmitter/receiver 160, a radio frequency (RF) combiner/divider 155, transmit/receive modules (T/R modules) 100, antenna elements 110, control computer 150, transmission lines 101 and data bus 108.

The transmitter/receiver 160 is connected to the RF combiner/divider 155 which in turn is connected via transmission lines 101 to each of the T/R modules 100. Each T/R module 100 is connected to and has associated with it at least one antenna element 110. Multiple antenna elements 110 can be configured together to form either a linear antenna array or a planar antenna array.

In a transmitting mode, the transmitter/receiver 160 provides RF signals to be transmitted by the antenna array. These signals are provided to the RF combiner/divider 155 which distributes the signals to the T/R modules 100 which, in turn, provide the signals to the antenna elements 110. When the transmitter/receiver 160 is acting as a receiver, signals received by antenna elements 110 are provided first to T/R modules 100 and then via transmission lines 101 to the RF combiner/divider 155 and thereafter to the transmitter/receiver 160.

Figure 2:
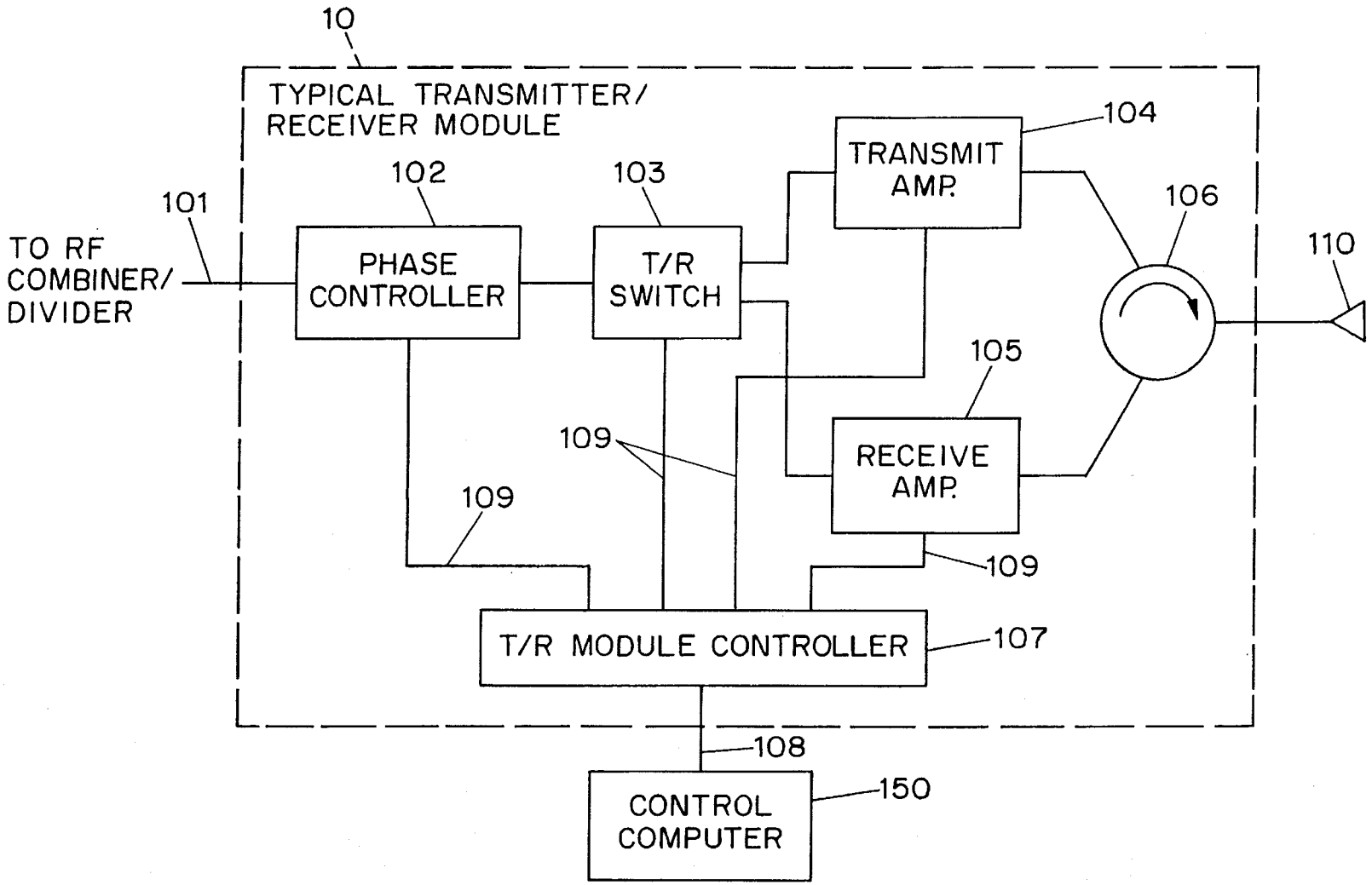
FIG. 2 (PRIOR ART)
FIG. 2 is a block diagram of a conventionally designed transmitter/receiver module found in the prior art.

A typical conventionally designed prior art T/R module 10, such as that designed by Raytheon and described in the text entitled "Brookner's Aspects of Modern Radar," is depicted in FIG. 2 and comprises an input/output port 101, a phase controller 102, a transmit/receive switch (T/R switch) 103, a transmit amplifier 104, a receive amplifier 105, and a three-port circulator 106. A typical prior art T/R module 10 may additionally include a T/R module controller 107 which is connected via a data bus 108 to control computer 150 and which receives digital signals from control computer 150 and provides driving signals to phase controller 102, T/R switch 103, transmit amplifier 104 and receive amplifier 105.

The phase controller 102, which may typically be a diode phase shifter, is controlled by control computer 150 in order to properly shape and steer the radiated RF signal being emitted by the phased array antenna. The phase controller 102 may also be used to compensate for differences in the respective RF signal path lengths between the transmitter/receiver 160 and the multiple antenna elements 110.

The T/R switch 103 alternately connects the phase controller 102 to the transmit amplifier 104 or to the receive amplifier 105. The circulator 106 is typically a three-port circulator and is conveniently provided between the transmit amplifier 104, antenna element 110 and the receive amplifier 105.

As previously discussed, the relative displacement of the antenna elements within an antenna array with respect to one another is not constant when the antenna elements move with respect to one another as a result of flexure or vibration within the antenna array. This relative movement of antenna elements introduces undesirable errors into the operation of the antenna array.

Figure 3:
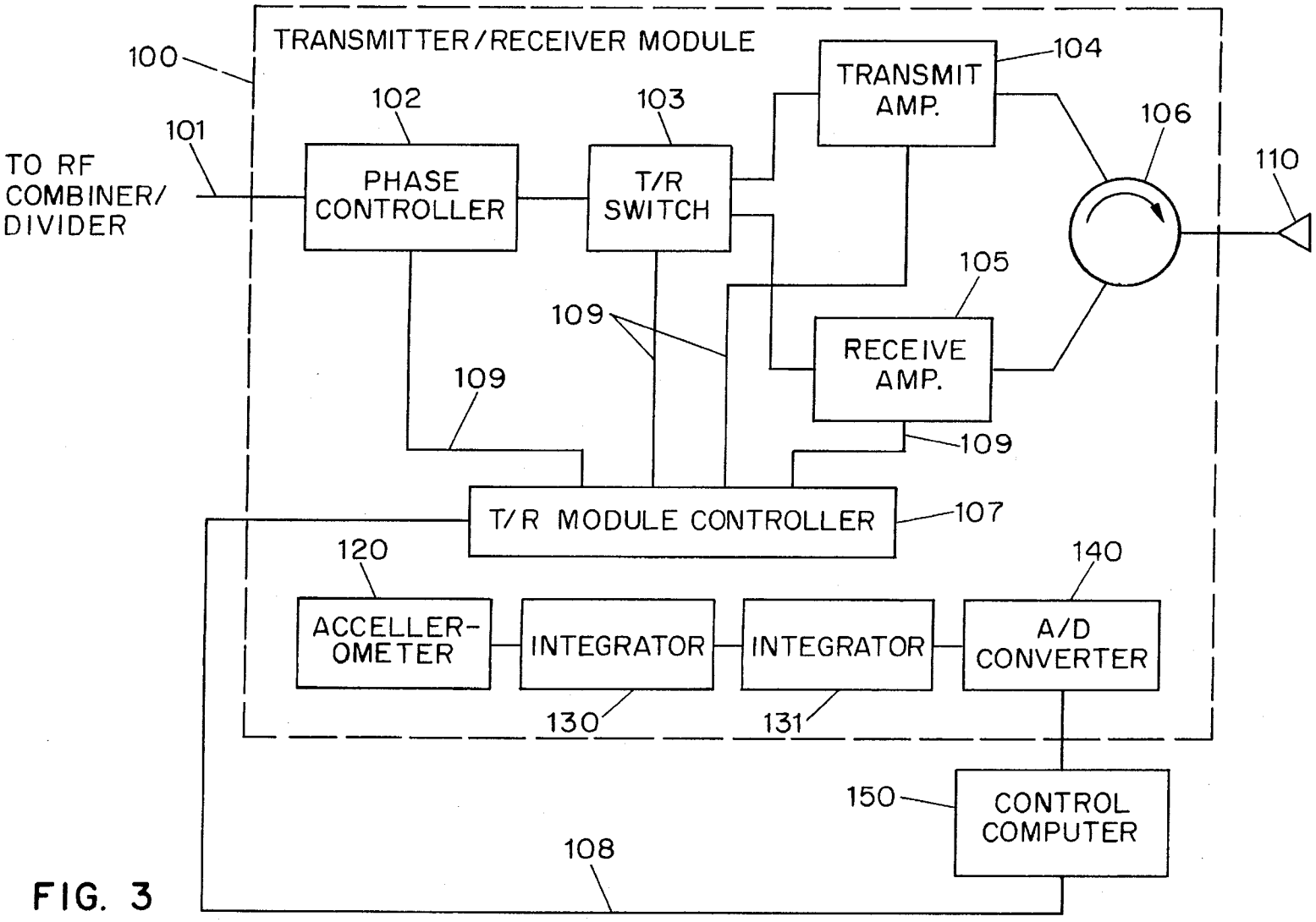
FIG. 3 is a block diagram of a transmitter/receiver module for an array antenna system in accordance with the present invention.

FIG. 3 depicts a preferred embodiment of a transmitter/receiver module 100 according to the present invention. In accordance with this preferred embodiment, the prior art T/R module 10 depicted in FIG. 2 is additionally provided with a position sensing means, preferably in the form of an inertial position sensor, to determine the relative displacement of each T/R module 100 and its associated antenna elements 110 with respect to the position of a reference antenna element within the antenna array. As depicted in FIG. 3, the present invention may implement the position sensing means with accelerometers 120, preferably accelerometers of the miniature integrated circuit tunnelling accelerometer type such as that recently developed by the Jet Propulsion Laboratory and described in the Feb. 11, 1994 issue of Aerospace Daily.

The accelerometers 120 sense the movement of each antenna element and its associated T/R module along at least the axis most subject to flexure and vibration. Acceleration information for each antenna element 110 is provided at the output of accelerometer 120 to integrators 130 and 131 which convert the accelerometer output signals into signals representative of velocity and displacement for each antenna element 110. The output of integrators 130 and 131 is converted by analog-to-digital (A/D) converter 140 into digital signals which are then provided to control computer 150 so that control computer 150 can determine the relative physical position of each antenna element 110 and its associated T/R module 100 with respect to its nominal position relative to the other antenna elements.

The control computer 150 may determine the relative physical position for each antenna element 110 by comparing the physical position signal for each antenna element 110 to the physical position signal for a reference antenna element and by then determining each antenna element's physical displacement from its nominal position in the antenna array with respect to the reference antenna element. The control computer 150 then uses this information to determine, for each antenna element 110, the amount of phase correction of the RF signal necessary to compensate for the element's displacement caused by antenna vibration and flexure. The control computer 150 implements this phase correction by appropriately configuring the signal which controls the phase controller 102 in the T/R module 100 for that antenna element 110.

During antenna transmission, this calculated phase correction is added to any other phase correction determined to be necessary for antenna element 110 in order to properly shape and direct the beam of the electronically steered phased array antenna. During antenna reception, the required phase correction is likewise added to any other phase correction determined to be necessary for proper signal reception by antenna element 110.

It should be noted that the configuration depicted in FIG. 3 is merely one embodiment of the present invention and the present invention could alternatively be configured in numerous other ways. For example, there could exist an accelerometer 120 for each antenna element 110, as depicted in FIG. 3, or alternatively, a single accelerometer could be used for a group of antenna elements. Also, the various processing and control components depicted in FIG. 3 could be combined or distributed in a variety of ways. Processing could take place in one or more centralized computers or in multiple distributed processors located at each antenna element 110. The phase correction required for compensation can be added to the phase correction required for beam shaping and steering in the control computer 150, as depicted in FIG. 3, or alternatively, could be added thereto by an external adder.

The functionality of control computer 150 can be distributed into multiple controllers or can be combined into a single unit together with the functionality of T/R module controller 107. In addition, integrators 130 and 131 and A/D converter 140 may or may not be co-located with antenna element 110. Furthermore, the processing performed by integrators 130 and 131 can be combined into a single integrator or could instead be performed digitally by the control computer 150 or by a separate controller.

Figure 4:
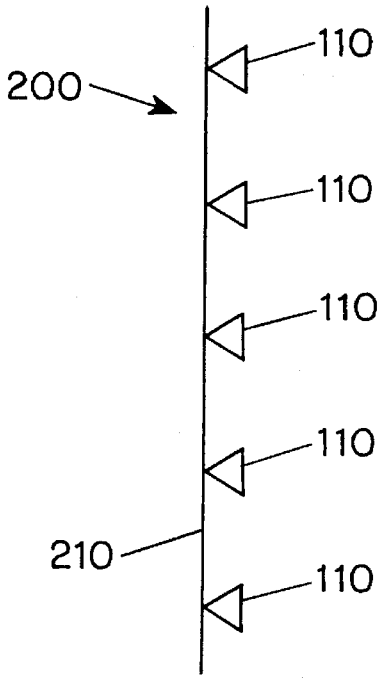
FIG. 4 illustrates a linear antenna array.

FIG. 4 depicts an array 200 of n (where n=5) antenna elements 110 mounted on a common platform 210. As depicted in FIG. 4, all n antenna elements 110 of the antenna array 200 are aligned in a linear array as would be the case if the array 200 was mounted on a straight platform 210 and was not subjected to any vibration or flexure. In the antenna array 200 depicted in FIG. 4, all n antenna elements are in a fixed position with respect to any point on the array platform 210 and with respect to one another. Accordingly, no compensation would be required to correct for movement, vibration or flexure of antenna array 200.

Figure 5:
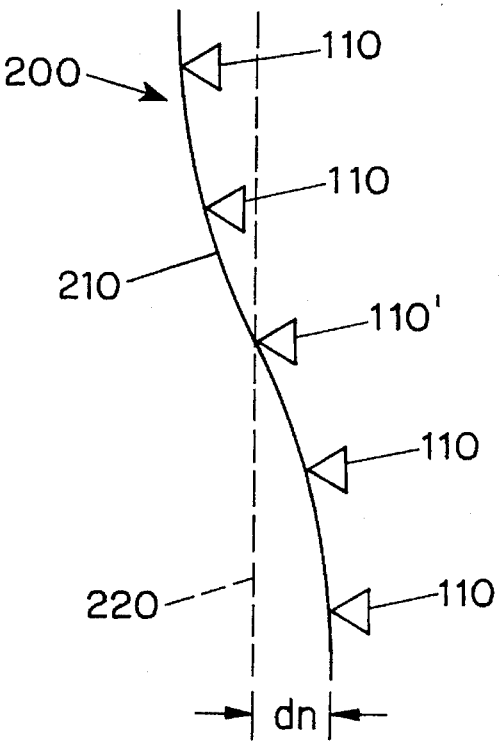
FIG. 5 illustrates a linear antenna array in a state of flexure, vibration and/or movement.

FIG. 5 depicts the same antenna array 200 comprising platform 210 and n antenna elements 110 as is depicted in FIG. 4. However, FIG. 5 represents antenna array 200 as it would exist in a state of vibration or flexure during which time the position of antenna elements 110 is not fixed with respect to one another or with respect the array platform 210 or with respect to the nominal line 220 of the platform 210. In order to maintain satisfactory antenna performance during periods of such vibration or flexure, compensation in the form of phase or time delay correction must be introduced into the microwave signals being radiated from and received by each of the n antenna elements 110.

By using integrators 130 and 131 to integrate acceleration information from the output signals of each accelerometer 120, positional information can be determined for each of the n antenna elements 110. Once the relative positional displacement $d_n$ from the nearest point on the reference line 220 is determined for each antenna element 110, the amount of phase correction required to compensate for that antenna element's relative positional displacement $d_n$ at that instant in time can be calculated by the equation:

$$\phi_c = \frac{2\pi d_n}{\lambda}$$

where $\emptyset_c$ is the phase shift, measured in radians, required to compensate for antenna element n's relative positional displacement $d_n$ from the closest point on the reference line 220, $d_n$ is antenna element n's relative positional displacement from the closest point on the reference plane 220, and $\lambda$ is the wavelength of the microwave signal being radiated from or received by antenna element 110. Control computer 150 can calculate relative positional displacement $d_n$ for antenna element n by determining the difference between the position for antenna element n and the position for a reference antenna element, such as element 110'. This process can be repeated by control computer 150 for each antenna element n in order to determine the relative positional displacement $d_n$ for each antenna element 110.

Figure 6:
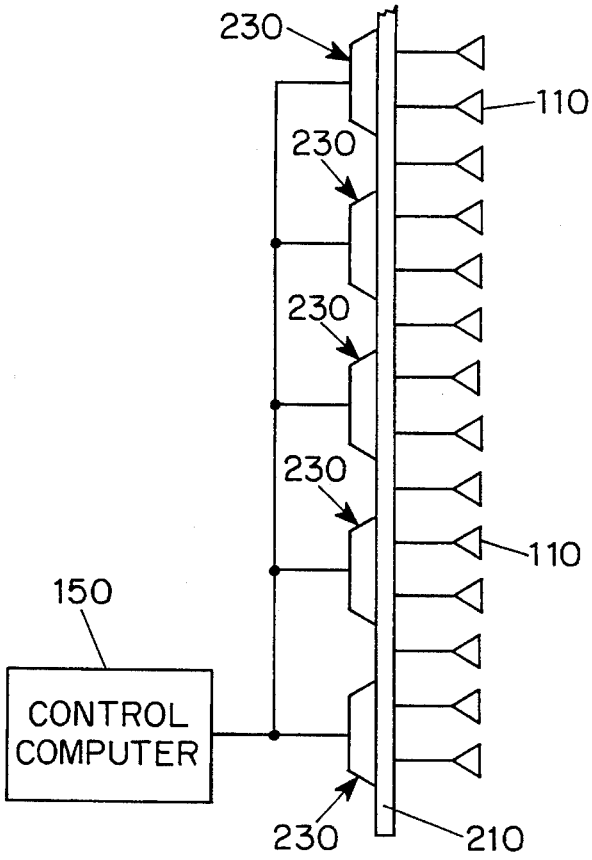
FIGS. 6–10 illustrate various antenna arrays.

Those skilled in the art will recognize that in accordance with the present invention it is possible to measure displacement of antenna elements or groups of antenna elements by other techniques than the eccelorometer described with respect to FIG. 3. FIG. 6 shows an alternate embodiment wherein an array of antenna elements 110 is mounted on a supporting structure 210. The supporting structure is provided with strain gages 230 which individually measure the localized deflection of supporting structure 210. The localized strain of each of strain gages 230 is provided to control computer 150 which can extrapolate the overall deflection of supporting structure 210 and accordingly the variation from nominal position for individual antenna elements 110.

Figure 7:
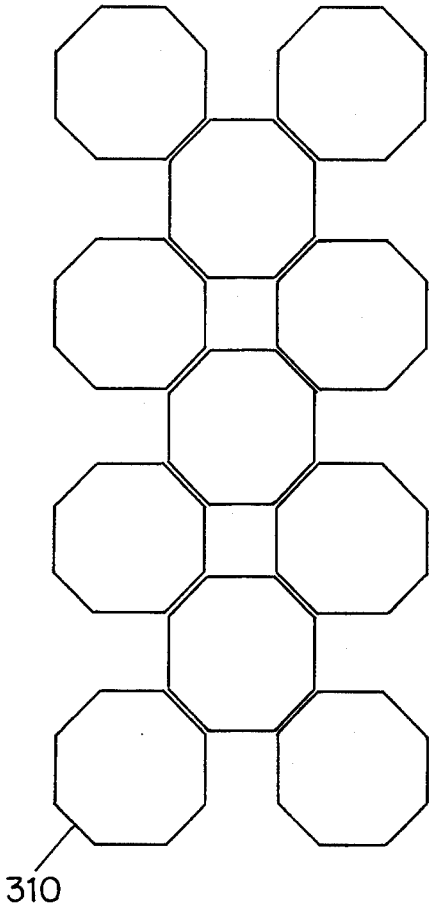
Figure 8:
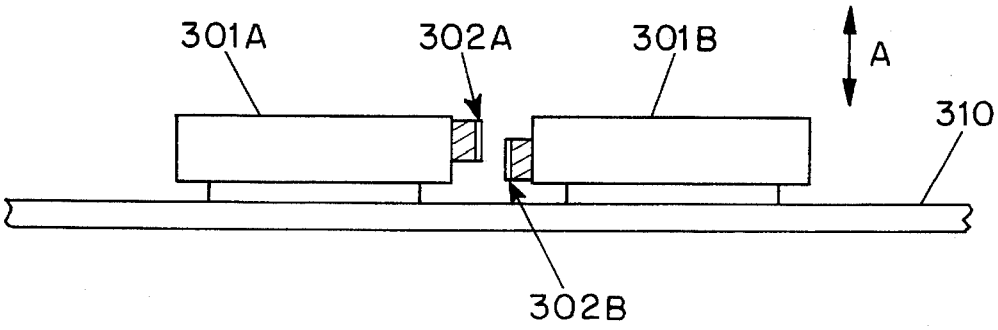

FIG. 7 shows another alternate embodiment consisting of an array arranged in modules 301, each of which may include a group of antenna elements. As shown in the FIG. 8 cross sectional view, modules 301 are mounted to a supporting structure 310 which may experience flexing. To measure the relative movement between modules 301 they are each provided with one-half of a capacitive element for measuring displacement. Thus as shown in FIG. 8, module 301*a* includes capacitor plate 302A and module 30lB is provided with an adjoining capacitor plate 302B. Displacement of antenna modules 301A and 301B in the direction of arrow A can be determined by measuring the capacitance between capacitor plates 302A and 302B. Thus, if module 301B moves upward with respect to module 301A capacitance between plates 302A and 302B is increased by reason of increasing capacitor plate overlap. If element group 301B is moved in the opposite direction, capacitance decreases.

Figure 9:
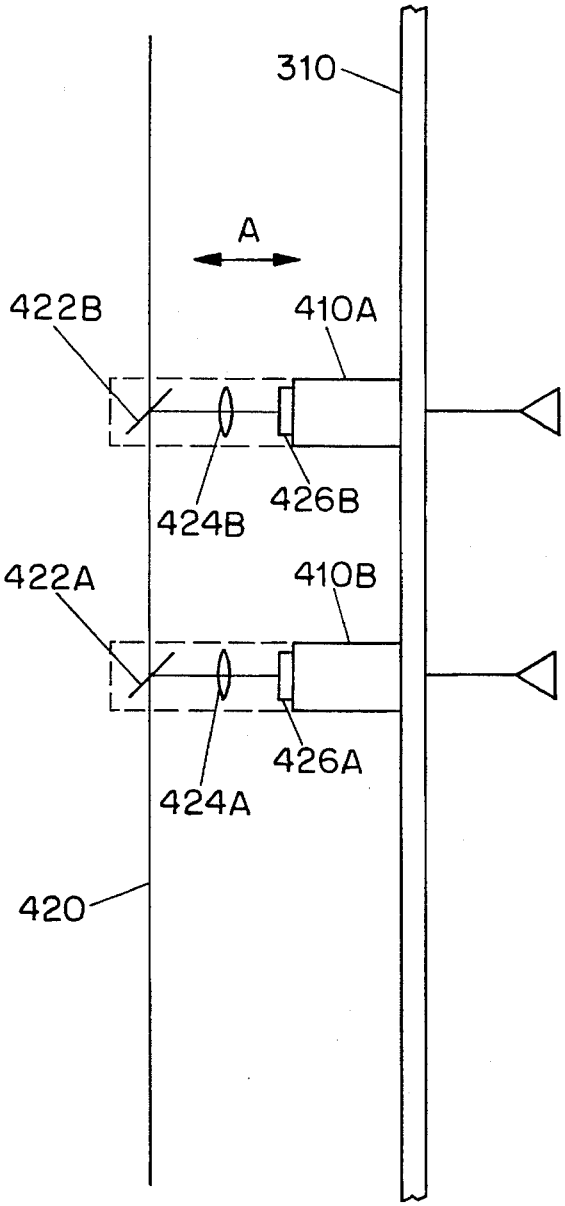
Figure 10:
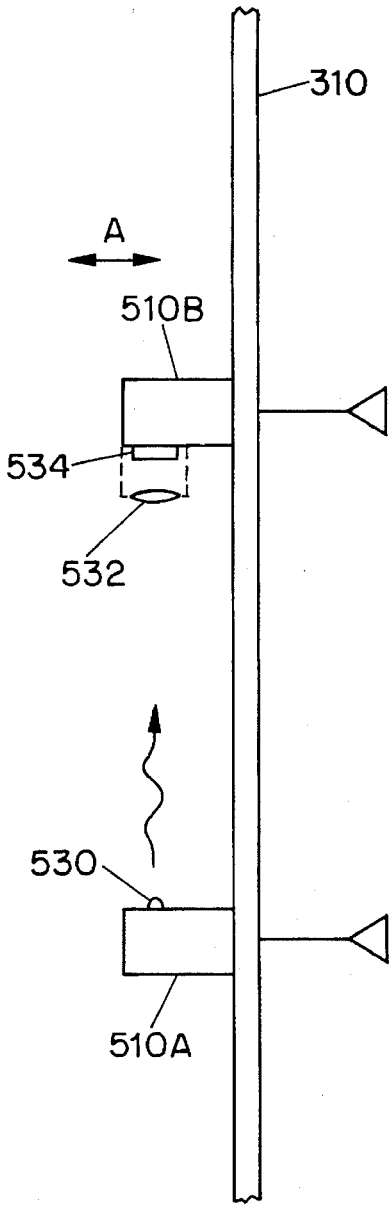

FIGS. 9 and 10 show alternate embodiments wherein the displacement of antenna elements by flexing of a supporting structure 310 is measured by optical techniques. In accordance with the embodiment of FIG. 9, a laser beam 420 is projected across elements and intercepted by partial reflecting mirrors 422A and 422B associated respectively with element modules 410A and 410B. The deflected laser light is focused by lenses 424A and 424B onto corresponding charge coupled device (CCD) detectors 426A and 426B. In the event of deflection of support structure 310, the position where laser 420 intercepts the respective partially reflecting mirrors 422 will change, and the position of laser detection on CCD detectors 426 will correspondingly change, to thereby detect the amount of movement in the relative positions of antenna module 410A and 410B in the direction of arrow A. In the embodiment of FIG. 10, element module 510A is provided with an LED emitter 530. A lens 532 on element module 510B projects the light from LED 530 onto CCD detector 534. In the event that supporting structure 310 bends, the position of the imaged LED light on CCD detector 534 will change, resulting in a detection of the corresponding displacement.

Although the foregoing discussion describes a preferred embodiment of the present invention to compensate for antenna array movement, vibration and flexure in only one dimension corresponding to a linear array, the present invention may be readily extended to compensate for movement, vibration and flexure in multiple dimensions in, for example, a planar or conformal array.

While there has been described what is believed to be a preferred embodiment of the invention, those skilled in the art will recognize that modifications may be made thereto without departing from the spirit of the invention and it is intended to claim all such modifications as fall within the scope of the invention.

We claim:

1. In an antenna system having a plurality of antenna elements, each for radiating and receiving electromagnetic signals, said system including means for providing signals to said antenna elements for radiation therefrom, means for detecting signals received by said antenna elements and means for controlling the phase of said radiated and said received signals, the improvement comprising:

means, including a position detector for determining the relative physical position of at least one of said antenna elements with respect to a nominal relative position for said antenna element in said antenna system;

means for computing a phase correction associated with the difference between said relative physical position and said nominal relative position; and means for operating said phase control means to compensate for said computed phase correction.

2. The system specified in claim 1 wherein at least portions of said means for providing signals, portions of said means for detecting signals, said phase control means, and said position detector are arranged together and adjacent to said antenna element.

3. The system specified in claim 1 wherein said position detector comprises an accelerometer.

4. The system specified in claim 3 wherein said accelerometer is a tunnelling accelerometer.

5. The system specified in claim 2 wherein said position detector comprises an accelerometer.

6. The system specified in claim 5 wherein said accelerometer is a tunnelling accelerometer.

7. The system specified in claim 1 wherein said position detector comprises an optical position detector.

8. An array antenna system comprising:

a plurality of antenna elements for radiating and receiving electromagnetic signals;

means for providing signals to said antenna elements for radiation therefrom;

means for detecting signals received by said antenna elements;

means for controlling the phase of said radiated and said received signals;

at least one position detector located at one of said antenna elements for determining the physical position of said one antenna element with respect to a reference antenna element in said array antenna;

means for computing the deviation of the position of said one antenna element from a nominal position with respect to said reference element and for computing a phase delay associated with said deviation; and means for operating said phase control means to compensate for said computed phase delay.

9. The system specified in claim 8 wherein at least each of said means for providing signals, said means for detecting signals, said phase control means, and said position detector are arranged together and adjacent to said antenna element.

10. A phased array antenna comprising:

a plurality of antenna element modules, each module comprising:

an antenna element;

a transmitter circuit coupled to said antenna element;

a receiver circuit coupled to said antenna element;

a phase shifter coupled to said transmitter and to said receiver circuit; and an accelerometer and integrator circuit;

a signal divider and combining means for providing signals to be transmitted to said modules and for combining signals received by said modules; and control means for receiving signals from said integrator circuits and computing a value of phase shift for said phase shifter in accordance with said integrator signals and with the desired pointing angle of said phased array, and for providing said phase shift value to said phase shifter.

11. In an antenna system having a plurality of antenna elements, each for receiving electromagnetic signals, said system including means for detecting signals received by said antenna elements and means for controlling the phase of said received signals, the improvement comprising:

means, including a position detector for determining the relative physical position of at least one of said antenna elements with respect to a nominal relative position for said antenna element in said antenna system;

means for computing a phase correction associated with the difference between said relative physical position and said nominal relative position; and means for operating said phase control means to compensate for said computed phase correction.

12. The system specified in claim 11 wherein at least portions of said means for detecting signals, said phase control means, and said position detector are arranged together and adjacent to said antenna element.

13. The system specified in claim 11 wherein said position detector comprises an accelerometer.

14. The system specified in claim 13 wherein said accelerometer is a tunnelling accelerometer.

15. The system specified in claim 12 wherein said position detector comprises an accelerometer.

16. The system specified in claim 15 wherein said accelerometer is a tunnelling accelerometer.

17. The system specified in claim 11 wherein said position detector comprises an optical position detector.

18. An array antenna system comprising:

a plurality of antenna elements for receiving electromagnetic signals;

means for detecting signals received by said antenna elements;

means for controlling the phase of said received signals;

at least one position detector located at one of said antenna elements for determining the physical position of said one antenna element with respect to a reference antenna element in said array antenna;

means for computing the deviation of the position of said one antenna element from a nominal position with respect to said reference element and for computing a phase delay associated with said deviation; and means for operating said phase control means to compensate for said computed phase delay.

19. The system specified in claim 18 wherein at least said phase control means, and said position detector are arranged together and adjacent to said antenna element.

20. A phased array antenna comprising:

a plurality of antenna element modules, each module comprising:

an antenna element;

a receiver circuit coupled to said antenna element;

a phase shifter coupled to said receiver circuit; and an accelerometer and integrator circuit;

a signal combining means for combining signals received by said modules; and control means for receiving signals from said integrator circuits and computing a value of phase shift for said phase shifter in accordance with said integrator signals and with the desired pointing angle of said phased array, and for providing said phase shift value to said phase shifter.

21. In an antenna system having a plurality of antenna elements, each for radiating electromagnetic signals, said system including means for providing signals to said antenna element for radiation therefrom and means for controlling the phase of said radiated signals, the improvement comprising:

means, including a position detector for determining the relative physical position of at least one of said antenna elements with respect to a nominal relative position for said antenna element in said antenna system;

means for computing a phase correction associated with the difference between said relative physical position and said nominal relative position; and means for operating said phase control means to compensate for said computed phase correction.

22. The system specified in claim 21 wherein at least portions of said means for detecting signals, said phase control means, and said position detector are arranged together and adjacent to said antenna element.

23. The system specified in claim 21 wherein said position detector comprises an accelerometer.

24. The system specified in claim 23 wherein said accelerometer is a tunnelling accelerometer.

25. The system specified in claim 22 wherein said position detector comprises an accelerometer.

26. The system specified in claim 25 wherein said accelerometer is a tunnelling accelerometer.

27. The system specified in claim 26 wherein said position detector comprises an optical position detector.

28. An array antenna system comprising:

a plurality of antenna elements for radiating electromagnetic signals;

means for providing signals to said antenna elements for radiation therefrom;

means for controlling the phase of said radiated signals;

at least one position detector located at one of said antenna elements for determining the physical position of said one antenna element with respect to a reference antenna element in said array antenna;

means for computing the deviation of the position of said one antenna element from a nominal position with respect to said reference element and for computing a phase delay associated with said deviation; and means for operating said phase control means to compensate for said computed phase delay.

29. The system specified in claim 28 wherein at least said phase control means, and said position detector are arranged together and adjacent to said antenna element.

30. A phased array antenna comprising:

a plurality of antenna element modules, each module comprising:

an antenna element;

a transmitter circuit coupled to said antenna element;

a phase shifter coupled to said transmitter circuit; and an accelerometer and integrator circuit;

a signal divider means for providing signals to be transmitted to said modules; and control means for receiving signals from said integrator circuits and computing a value of phase shift for said phase shifter in accordance with said integrator signals and with the desired pointing angle of said phased array, and for providing said phase shift value to said phase shifter.

* * * * *